US006453706B1

(12) United States Patent
Chen

(10) Patent No.: US 6,453,706 B1
(45) Date of Patent: Sep. 24, 2002

(54) PADLOCK WITH A U-SHAPED LOCK CASING

(76) Inventor: Waterson Chen, 8F, No. 428, Wu-Chuan-Nan Rd., Taichung City (TW)

( * ) Notice: Subject to any disclaimer, the term of this patent is extended or adjusted under 35 U.S.C. 154(b) by 0 days.

(21) Appl. No.: 09/576,661

(22) Filed: May 23, 2000

(51) Int. Cl.[7] ..... E05B 67/36

(52) U.S. Cl. ..... 70/33; 70/226; 70/233; 70/368

(58) Field of Search ..... 70/32–34, 225, 70/226, 233, 234, 368, 371

(56) References Cited

U.S. PATENT DOCUMENTS

| | | | | | |
|---|---|---|---|---|---|
| 627,238 | A | | 6/1899 | Peterson | 70/423 |
| 1,195,808 | A | | 8/1916 | Grgich | 70/423 |
| 2,104,981 | A | * | 1/1938 | Falk | 70/33 |
| 2,656,704 | A | * | 10/1953 | Mancuso | 70/32 X |
| 2,930,219 | A | | 3/1960 | Fansmith | 70/54 |
| 2,999,377 | A | | 9/1961 | Raye | 70/32 |
| 3,714,804 | A | | 2/1973 | French | 70/423 X |
| 3,858,419 | A | | 1/1975 | Hampton | 70/55 |
| 4,222,253 | A | * | 9/1980 | Peitsmeier | 70/68 X |
| 4,286,445 | A | | 9/1981 | Sills | 70/55 |
| 4,404,825 | A | * | 9/1983 | Dixon et al. | 70/368 |
| 4,869,082 | A | | 9/1989 | Appelbaum | 70/63 |
| 4,881,391 | A | | 11/1989 | Villa et al. | 70/455 |
| 4,953,371 | A | | 9/1990 | Appelbaum | 70/32 |
| 5,365,758 | A | * | 11/1994 | Shieh | 70/33 |
| 5,442,941 | A | * | 8/1995 | Kahonen et al. | 70/33 X |
| 5,517,837 | A | * | 5/1996 | Wang | 70/33 X |
| 5,544,506 | A | * | 8/1996 | Nakano | 70/34 |
| 5,979,200 | A | * | 11/1999 | Cliff | 70/368 X |
| 5,987,939 | A | * | 11/1999 | Pitisettakarn | 70/33 |

FOREIGN PATENT DOCUMENTS

| | | | | |
|---|---|---|---|---|
| CH | 472564 | * | 6/1969 | 70/33 |
| DE | 2810756 | * | 9/1978 | 70/33 |
| IT | 411689 | * | 3/1945 | 70/33 |
| IT | 412692 | * | 2/1946 | 70/33 |
| IT | 417571 | * | 1/1947 | 70/33 |
| IT | 435219 | | 3/1948 | 70/33 |
| IT | 455873 | * | 3/1950 | 70/33 |

* cited by examiner

*Primary Examiner*—Suzanne Dino Barrett
(74) *Attorney, Agent, or Firm*—Merchant & Gould P.C.

(57) ABSTRACT

A padlock includes a lock casing having a core receiving space, a latch recess communicated with the core receiving space, a first shackle insert hole, a second shackle insert hole aligned with the first shackle insert hole, and a slide channel communicating the second shackle insert hole with the latch recess. A lock core unit includes a latch member extending into the latch recess and rotatable inside the latch recess between locking and unlocking positions. A shackle bar extends into the first and second shackle insert holes. A catch member is disposed slidably in the latch recess, and has a first abutment wall formed with a shackle engaging projection that extends into the slide channel, a second abutment wall spaced apart from the first abutment wall, and a latch cavity defined between the first and second abutment walls for extension of the latch member thereinto. The latch member pushes the first abutment wall to enable the shackle engaging projection to project into the second shackle insert hole and engage the shackle bar when the latch member is disposed in the locking position. The latch member pushes the second abutment wall to enable the shackle engaging portion to retract into the slide channel and disengage from the shackle bar when the latch member is disposed in the unlocking position.

6 Claims, 5 Drawing Sheets

PADLOCK WITH A U-SHAPED LOCK CASING

BACKGROUND OF THE INVENTION

1. Field of the Invention

The invention relates to a padlock with a U-shaped lock casing, more particularly to a padlock which can minimize malfunctioning thereof due to spring fatigue.

2. Description of the Related Art

A conventional padlock includes a lock casing, a key-operated lock core unit mounted in the lock casing, a shackle bar inserted between opposite shackle mounting portions of the lock casing for retaining an object on the lock casing between the opposite shackle mounting portions, and spring-loaded tumbler means associated operably with the lock core unit for engaging removably the shackle bar. The conventional padlock generally suffers from the disadvantage that the lock core unit is not removable from the lock casing. As such, in case of spring fatigue that leads to malfunctioning of the padlock, the entire padlock has to be discarded although the lock core unit is still operable. In Applicant's co-pending U.S. patent application Ser. No. 09/395,521, filed on Sep. 14, 1999, the entire disclosure of which is incorporated herein by reference, there is disclosed a padlock assembly with a lock casing and a lock mechanism which is mounted removably in the lock casing. A spring-loaded latch bar is provided in the lock casing, and is associated operably with the lock mechanism for engaging removably a shackle bar of the padlock assembly. As spring fatigue of the latch bar is usually unavoidable after the padlock assembly has been in use for a period of time, it is thus desirable to provide a padlock which incorporates a fewer number of spring members to reduce the possibility of malfunctioning thereof due to spring fatigue.

SUMMARY OF THE INVENTION

Therefore, the object of the present invention is to provide a padlock which can minimize malfunctioning thereof due to spring fatigue.

Accordingly, the padlock of the present invention includes a lock casing, a key-operated lock core unit, a shackle bar, and a catch member. The lock casing has first and second end surfaces which are opposite to each other in a longitudinal direction, and includes a lock core mounting portion adjacent to the first end surface and formed with a core receiving space that extends in the longitudinal direction from the first end surface toward the second end surface, a latch receiving portion adjacent to the second end surface and formed with a latch recess communicated with the core receiving space, a first shackle mounting portion that extends from the lock core mounting portion in a first transverse direction transverse to the longitudinal direction and that is formed with a first shackle insert hole, and a second shackle mounting portion that extends from the latch receiving portion in the first transverse direction and that is opposite to the first shackle mounting portion. The second shackle mounting portion is formed with a second shackle insert hole that is aligned with the first shackle insert hole in the longitudinal direction. The second shackle mounting portion is further formed with a slide channel that extends in the first transverse direction to communicate the second shackle insert hole with the latch recess. The lock core unit includes a cylindrical lock core and a latch member. The lock core is formed with a keyhole, and is disposed in the core receiving space. The lock core is adapted to be rotated inside the core receiving space upon insertion of a corresponding key into the keyhole. The lock core has one end disposed adjacent to the latch recess. The latch member is connected to said one end of the lock core, and extends into the latch recess. The latch member is rotatable inside the latch recess between locking and unlocking positions when the corresponding key is operated. The shackle bar has a first end extending into the first shackle insert hole, and a second end extending into the second shackle insert hole. At least one of the first and second ends is removable from a corresponding one of the first and second shackle insert holes. The catch member is disposed slidably in the latch recess, and has a first abutment wall which is formed with a shackle engaging projection that extends into the slide channel, a second abutment wall spaced apart from the first abutment wall in the first transverse direction, and a latch cavity defined between the first and second abutment walls for extension of the latch member thereinto. The latch member pushes the first abutment wall of the catch member for moving the catch member in the first transverse direction toward the second shackle mounting portion so as to enable the shackle engaging projection to project into the second shackle insert hole for engaging the shackle bar when the latch member is disposed in the locking position. The latch member pushes the second abutment wall of the catch member for moving the catch member in a direction opposite to the first transverse direction away from the second shackle mounting portion so as to enable the shackle engaging portion to retract into the slide channel for disengaging from the shackle bar when the latch member is disposed in the unlocking position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
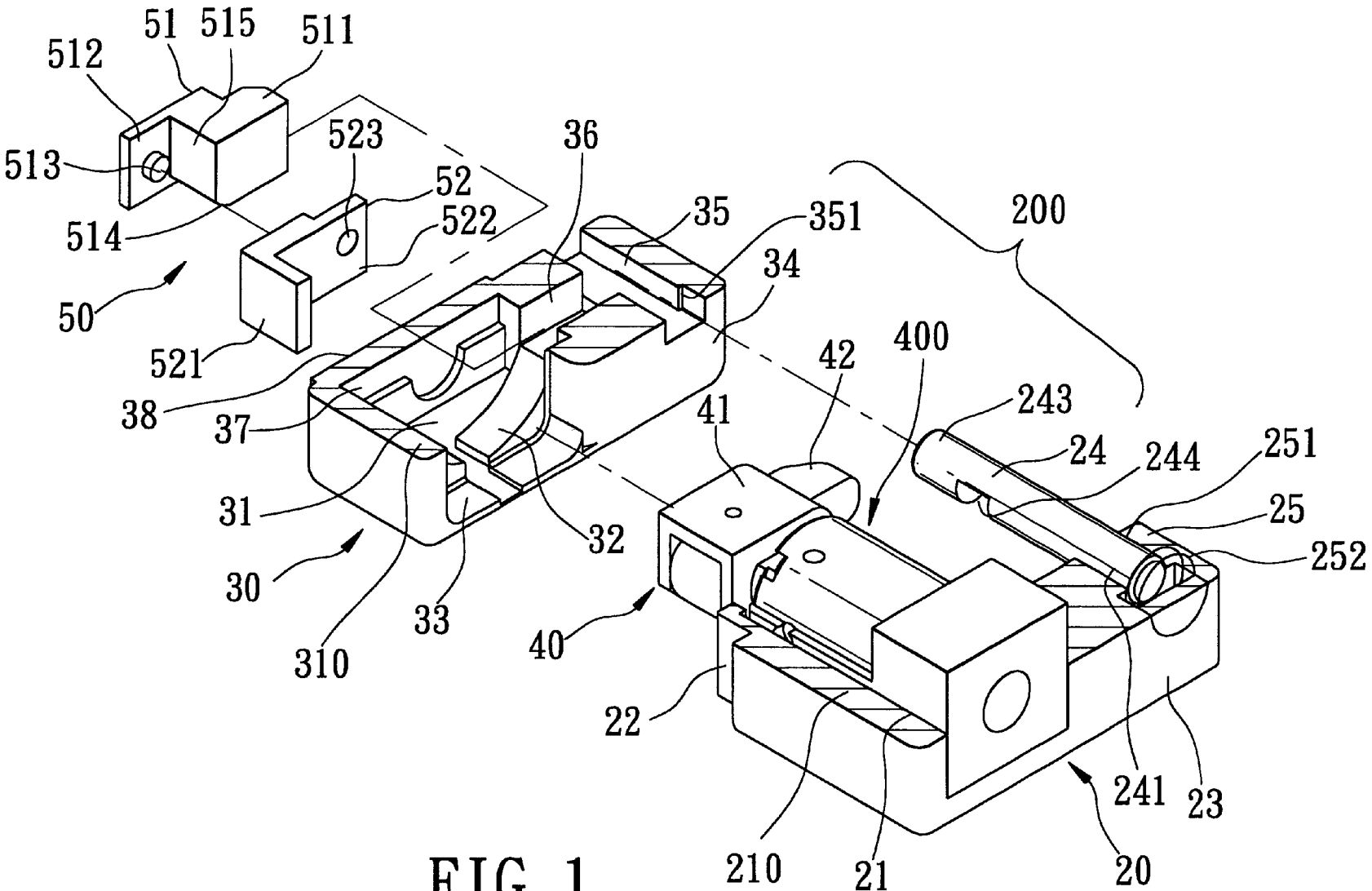
FIG. 1 is a partly sectional, exploded perspective view of a preferred embodiment of the padlock of the present invention.
Figure 2:
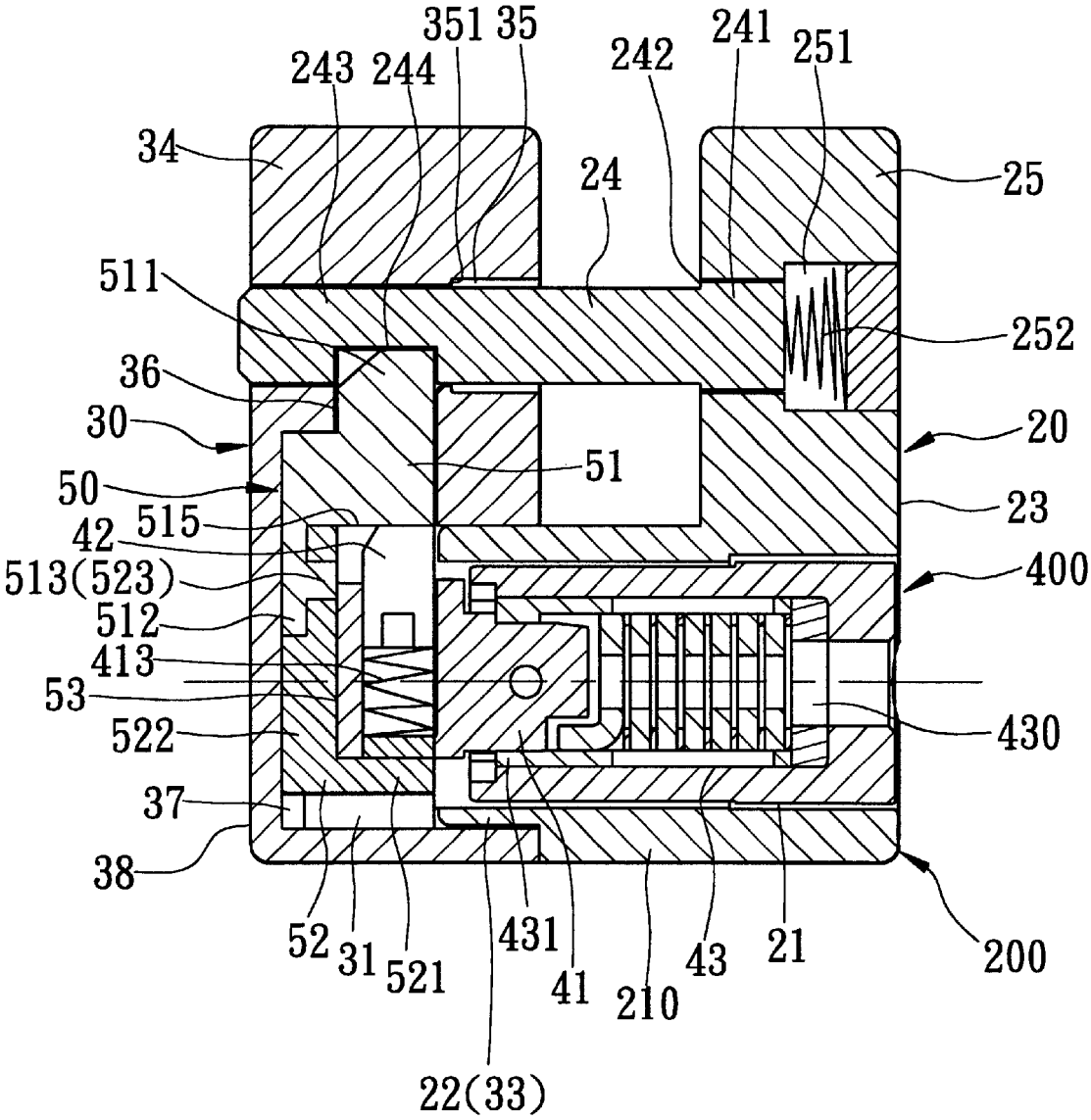
FIG. 2 is a cross-sectional view of the preferred embodiment when in a locking state.
Figure 3:
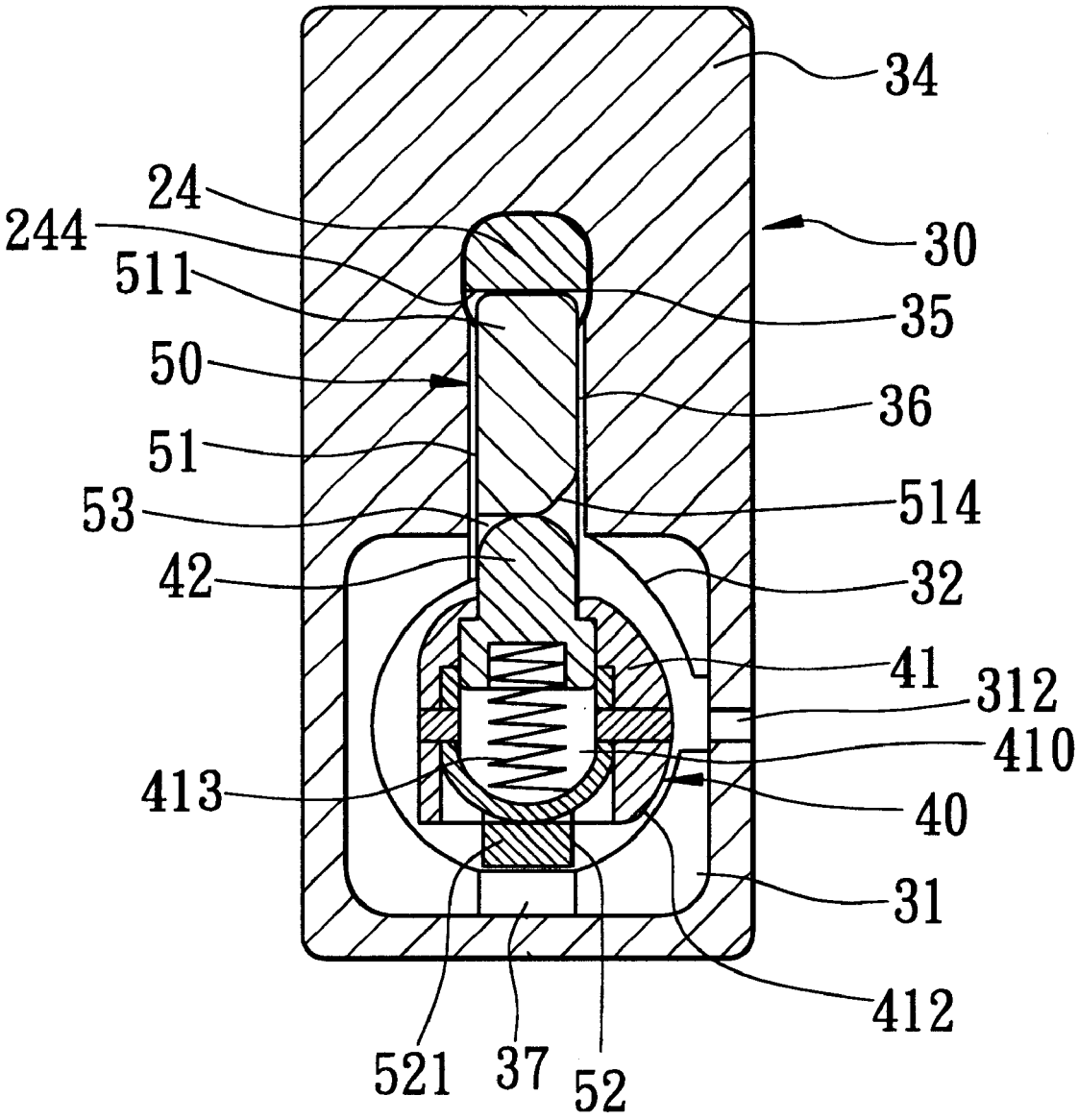
FIG. 3 is another cross-sectional view of the preferred embodiment when in the locking state, viewed from another angle.

Referring to FIGS. 1 to 3, the preferred embodiment of the padlock of the present invention is shown to include a U-shaped lock casing 200, a key-operated lock core unit 400, a shackle bar 24, and a catch member 50.

The lock casing 200 includes a first casing part 20 and a second casing part 30 secured to the first casing part 20. The first casing part 20 has a first end surface 23, a lock core mounting portion 210 extending from the first end surface 23 in a longitudinal direction, and a first shackle mounting portion 25 extending from the lock core mounting portion 210 in a first transverse direction transverse to the longitudinal direction. The lock core mounting portion 210 has an insert end 22 opposite to the first end surface 23. The lock core mounting portion 210 is formed with a core receiving space 21 that extends in the longitudinal direction from the first end surface 23 through the insert end 22. The first shackle mounting portion 25 is formed with a blind first shackle insert hole 251 which is provided with a biasing spring 252.

The second casing part 30 has a second end surface 38 which is opposite to the first end surface 23 of the first casing part 20 in the longitudinal direction, a latch receiving portion 310 adjacent to the second end surface 38, and a second shackle mounting portion 34 that extends from the latch receiving portion 310 in the first transverse direction. The latch receiving portion 310 is formed with a latch recess 31 and a latch entrance 33 which is communicated with the latch recess 31 and which receives fittingly the insert end 22 of the lock core mounting portion 210 such that the latch recess 31 is communicated with the core receiving space 21. The latch receiving portion 310 is welded to the insert end 22 of the lock core mounting portion 210 of the first casing part 20. The latch recess 31 has an inner surface formed with a curved wall 32, and a slide groove 37 that extends in the first transverse direction. The second shackle mounting portion 34 is opposite to the first shackle mounting portion 25 in the longitudinal direction, and has a second shackle insert hole 35 formed therethrough. The second shackle insert hole 35 extends in the longitudinal direction, and is aligned with the first shackle insert hole 251. The second shackle insert hole 35 has an inner surface formed with a retaining shoulder 351 that confronts the first shackle mounting portion 25. The second lock casing 30 is further formed with a slide channel 36 that extends in the first transverse direction to communicate the second shackle insert hole 35 with the latch recess 31.

The lock core unit 400 includes a cylindrical lock core 43 formed with a keyhole 430 and disposed in the core receiving space 21. The lock core 43 is adapted to be rotated inside the core receiving space 21 upon insertion of a corresponding key (not shown) into the keyhole 430. The lock core 43 has one end 431 disposed adjacent to the insert end 22 of the lock core mounting portion 210. The lock core unit 400 further includes a latch member 40 connected to the end 431 of the lock core 43 and extending out of the core receiving space 21. The latch member 40 extends into the latch recess 31, and is rotatable inside the latch recess 31 between locking and unlocking positions when the corresponding key is operated. The latch member 40 includes a latch base 41 coupled to the end 431 of the lock core 43 and formed with a slide passage 410 that extends in a second transverse direction transverse to the longitudinal direction, a latch body 42 mounted on the latch base 41 inside the slide passage 410, and a biasing spring 413 for biasing the latch body 42 to extend outwardly of the slide passage 410 and to project from the latch base 41 in the second transverse direction. The latch base 41 has a convex outer wall surface 412.

The shackle bar 24 is an elongate straight bar, and has a first end 241 which extends removably into the first shackle insert hole 251 and which is formed with an abutment shoulder 242 confronting the second shackle mounting portion 34, and a second end 243 which extends through the second shackle insert hole 35 and which is formed with a shackle groove 244.

The catch member 50 is disposed in the latch recess 31, and is slidable along the slide groove 37. The catch member 50 includes a first catch body 51, and a second catch body 52 connected to the first catch body 51. The first catch body 51 has a first abutment wall 515, a shackle engaging projection 511 projecting from the first abutment wall 515 in the first transverse direction and extending into the slide channel 36, and a first connecting wall 512 extending from the first abutment wall 515 opposite to the shackle engaging projection 511. The first abutment wall 515 has an edge portion formed with a bevel face 514 that confronts the latch member 40. The first connecting wall 512 is formed with an engaging stud 513. The second catch member 52 includes a second abutment wall 521 which is opposite to the first abutment wall 515 in the first transverse direction, and which is spaced-apart from and parallel to the first abutment wall 515, and a second connecting wall 522 which extends from the second abutment wall 521 in the first transverse direction toward the first catch body 51. The second connecting wall 522 is formed with an engaging hole 523 for engaging the engaging stud 513 of the first catch body 51 such that the second catch body 52 is slidable together with the first catch body 51 in the first transverse direction along the slide groove 37. A latch cavity 53 is defined between the first and second abutment walls 515, 521 to permit extension of the latch member 40 thereinto.

When the latch member 40 is disposed in the locking position, the latch body 42 abuts against and pushes the first abutment wall 515 of the first catch body 51 to cause the first and second catch bodies 51, 52 to slide along the slide groove 37 toward the second shackle mounting portion 34 so as to enable the shackle engaging projection 511 to project into the second shackle insert hole 35 and engage the shackle groove 244 in the second end 243 of the shackle bar 24.

Figure 4:
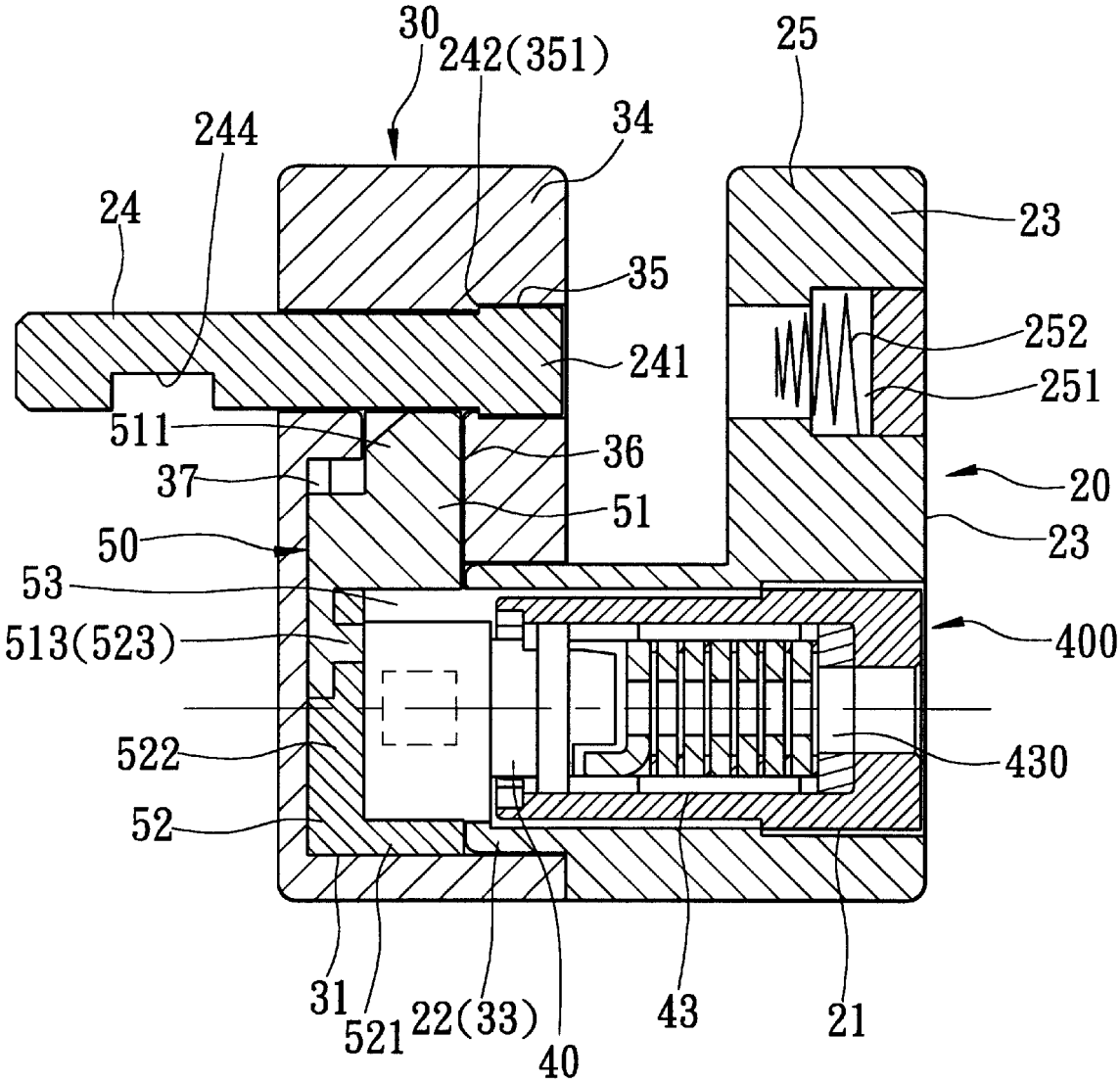
FIG. 4 is a cross-sectional view of the preferred embodiment when in an unlocking state.
Figure 5:
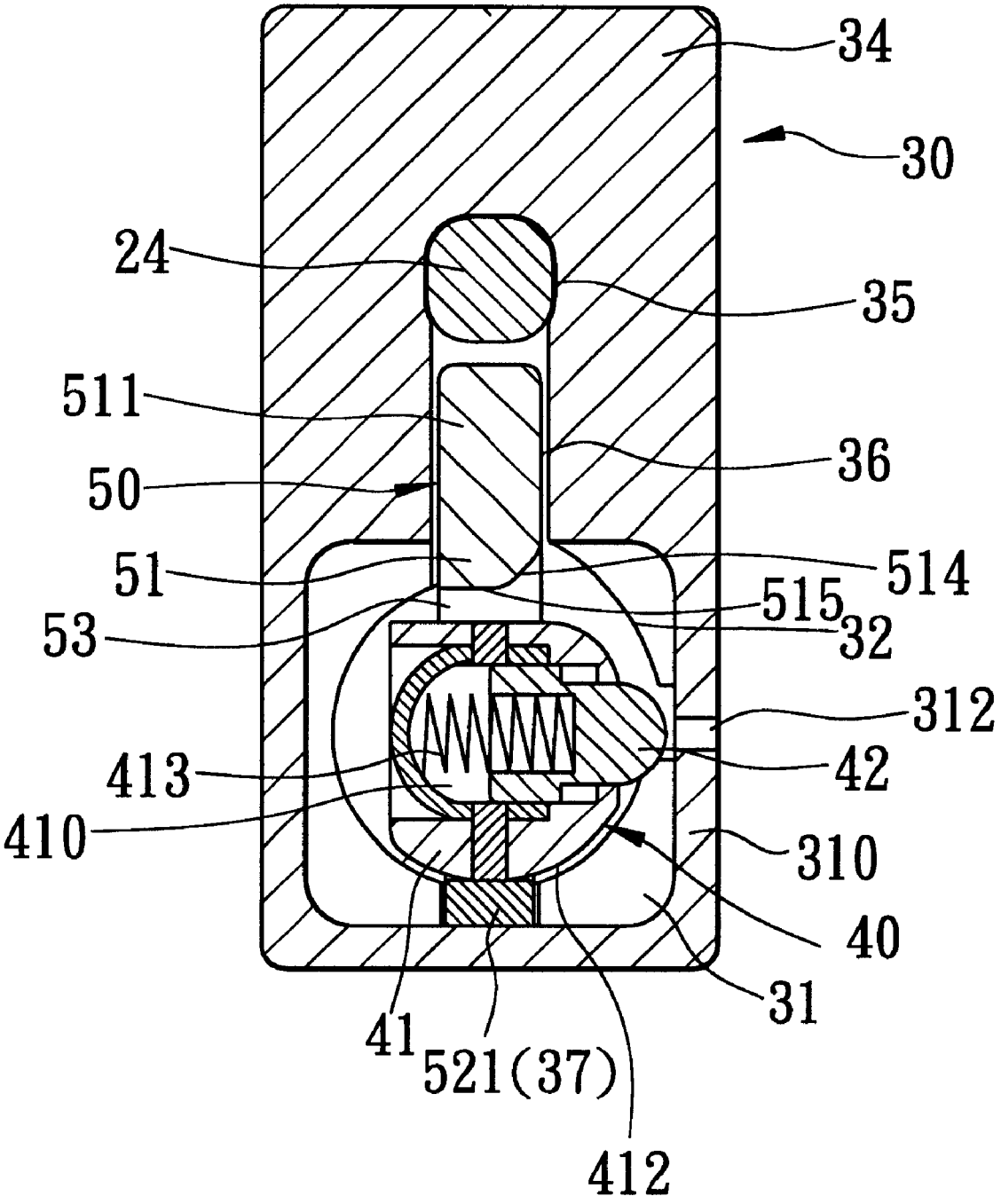
FIG. 5 is another cross-sectional view of the preferred embodiment when in the unlocking state, viewed from said another angle.

Referring to FIGS. 4 and 5, to unlock the padlock, the key is inserted into the keyhole 430 to rotate the lock core 43 and cause rotation of the latch member 40 to the unlocking position. The latch body 42 slides along the curved wall 32, and is pushed by the curved wall 32 to extend inwardly and partly into the slide passage 410 against biasing action of the biasing spring 413. At this time, the convex outer wall surface 412 of the latch base 41 abuts against and pushes the second abutment wall 521 of the second catch body 52 to cause the first and second catch bodies 51, 52 to slide along the slide groove 37 in a direction away from the second shackle mounting portion 34 so as to enable the shackle engaging projection 511 to retract into the slide channel 36 and disengage from the shackle bar 24. The shackle bar 24 is thus moved in the longitudinal direction away from the first shackle mounting portion 25 for removing the first end 241 thereof from the first shackle insert hole 251 due to the biasing action of the biasing spring 252 provided in the first shackle insert hole 251. The abutment shoulder 242 at the first end 241 of the shackle bar 24 abuts against the retaining shoulder 351 in the second shackle insert hole 35 to prevent removal of the shackle bar 24 from the second shackle insert hole 35. As shown in FIG. 5, when the latch member 40 is rotated once again from the unlocking position to the locking position, the latch body 42 slides past the bevel face 514 of the first catch body 51 for abutting against the first abutment wall 515.

The latch receiving portion 310 of the second casing part 30 is preferably formed with a radial hole 312 communicated with the latch recess 31. The radial hole 312 is adapted to permit insertion of a tool (not shown) therein for retracting the latch body 42 into the slide passage 410 when the latch member 40 is disposed in the unlocking position. When the latch body 42 is retracted within the latch base 41 along the slide passage 410, the latch base 41 has a size sufficient for retraction into the core receiving space 21 and for removal of the lock core unit 400 from the core receiving space 21. Thus, the lock core unit 400 can be replaced with a new set when damaged, such as in the event of spring fatigue.

It has thus been shown that, in the preferred embodiment, the catch member 50 is actuatable by the latch member 40 to slide toward and away from the second shackle insert hole 35 for engaging and disengaging from the shackle bar 24 upon rotation of the latch member 40 between the locking and unlocking positions. In case that spring fatigue of the spring 413 of the latch member 40 occurs, the latch member 40 is still operable to rotate inside the latch recess 31 for moving to the unlocking position and for disengaging the catch member 50 from the shackle bar 24. By replacing the lock core unit 400 with a new set, the padlock can be used once again.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A padlock comprising:

(a) lock casing having first and second end surfaces which are opposite to each other in a longitudinal direction, and including:

a lock core mounting portion adjacent to said first end surface and formed with a core receiving space that extends in the longitudinal direction from said first end surface toward said second end surface, a latch receiving portion adjacent to said second end surface and formed with a latch recess communicated with said core receiving space, a first shackle mounting portion that extends from said lock core mounting portion in a first transverse direction transverse to the longitudinal direction and that is formed with a first shackle insert hole, and a second shackle mounting portion that extends from said latch receiving portion in the first transverse direction and that is opposite to said first shackle mounting portion, said second shackle mounting portion being formed with a second shackle insert hole that is aligned with said first shackle insert hole in the longitudinal direction, said second shackle mounting portion being further formed with a slide channel that extends in the first transverse direction to communicate said second shackle insert hole with said latch recess;

(b) a key-operated lock core unit including a cylindrical lock core formed with a keyhole and disposed in said core receiving space, said lock core being adapted to be rotated inside said core receiving space upon insertion of a corresponding key into said keyhole, said lock core having one end disposed adjacent to said latch recess, and a latch member connected to said one end of said lock core and extending into said latch recess, said latch member being rotatable inside said latch recess between locking and unlocking positions when the corresponding key is operated;

(c) a shackle bar having a first end extending into said first said shackle insert hole, and a second end extending into said second shackle insert hole, at least one of said first and second ends being removable from a corresponding one of said first and second shackle insert holes; and (d) a catch member disposed slidably in said latch recess and having a first abutment wall which is formed with a shackle engaging projection that extends into said slide channel, a second abutment wall spaced apart from said first abutment wall in the first transverse direction, and a latch cavity defined between said first and second abutment walls for extension of said latch member thereinto, said latch member pushing said first abutment wall of said catch member for moving said catch member in the first transverse direction toward said second shackle mounting portion so as to enable said shackle engaging projection to project into said second shackle insert hole for engaging said shackle bar when said latch member is disposed in the locking position, said latch member pushing said second abutment wall of said catch member for moving said catch member in a direction opposite to the first transverse direction away from said second shackle mounting portion so as to enable said shackle engaging portion to retract into said slide channel for disengaging from said shackle bar when said latch member is disposed in the unlocking position;

wherein said catch member includes a first catch body formed with said first abutment wall, and a second catch body connected to said first catch body and formed with said second abutment wall, said second abutment wall being parallel to and being spaced apart from said first abutment wall.

2. The padlock according to claim 1, wherein said first catch body further has a first connecting wall which extends from said first abutment wall toward said second abutment wall and which is formed with an angaging stud, said second catch body further having a second connecting wall which extends from said second abutment wall toward said first abutment wall and which is formed with an engaging hole for engaging said engaging stud.

3. A padlock comprising:

(a) lock casing having first and second end surfaces which are opposite to each other in a longitudinal direction, and including:

a lock core mounting portion adjacent to said first end surface and formed with a core receiving space that extends in the longitudinal direction from said first end surface toward said second end surface, a latch receiving portion adjacent to said second end surface and formed with a latch recess communicated with said core receiving space, a first shackle mounting portion that extends from said lock core mounting portion in a first transverse direction transverse to the longitudinal direction and that is formed with a first shackle insert hole, and a second shackle mounting portion that extends from said latch receiving portion in the first transverse direction and that is opposite to said first shackle mounting portion, said second shackle mounting portion being formed with a second shackle insert hole that is aligned with said first shackle insert hole in the longitudinal direction, said second shackle mounting portion being further formed with a slide channel that extends in the first transverse direction to communicate said second shackle insert hole with said latch recess;

(b) a key-operated lock core unit including a cylindrical lock core formed with a keyhole and disposed in said core receiving space, said lock core being adapted to be rotated inside said core receiving space upon insertion of a corresponding key into said keyhole, said lock core having one end disposed adjacent to said latch recess, and a latch member connected to said one end of said lock core and extending into said latch recess, said latch member being rotatable inside said latch recess between locking and unlocking positions when the corresponding key is operated;

(c) a shackle bar having a first end extending into said first said shackle insert hole, and a second end extending into said second shackle insert hole, at least one of said first and second ends being removable from a corresponding one of said first and second shackle insert holes; and (d) a catch member disposed slidably in said latch recess and having a first abutment wall which is formed with a shackle engaging projection that extends into said slide channel, a second abutment wall spaced apart from said first abutment wall in the first transverse direction, and a latch cavity defined between said first and second abutment walls for extension of said latch member thereinto, said latch member pushing said first abutment wall of said catch member for moving said catch member in the first transverse direction toward said second shackle mounting portion so as to enable said shackle engaging projection to project into said second shackle insert hole for engaging said shackle bar when said latch member is disposed in the locking position, said latch member pushing said second abutment wall of said catch member for moving said catch member in a direction opposite to the first transverse direction away from said second shackle mounting portion so as to enable said shackle engaging portion to retract into said slide channel for disengaging from said shackle bar when said latch member is disposed in the unlocking position;

wherein said latch member includes:

a latch base coupled to said one end of said lock core and formed with a slide passage that extends in a second transverse direction transverse to the first longitudinal direction; and a spring-loaded latch body mounted on said latch base inside said slide passage, said latch body being biased to extend outwardly of said slide passage and projecting from said latch base, said latch body abutting against said first abutment wall of said catch member when said latch member is disposed in the locking position.

4. The padlock according to claim 3, wherein said latch base has a convex outer wall surface which abuts against said second abutment wall of said catch member for moving said catch member away from said second shackle mounting portion when said latch member is moved from the locking position to the unlocking position.

5. The padlock according to claim 3, wherein said latch member has a size sufficient for retraction into said core receiving space and for removal of said lock core unit from said core receiving space when said latch body is retracted into said slide passage.

6. A padlock comprising:

(a) lock casing having first and second end surfaces which are opposite to each other in a longitudinal direction, and including:

a lock core mounting portion adjacent to said first end surface and formed with a core receiving space that extends in the longitudinal direction from said first end surface toward said second end surface, a latch receiving portion adjacent to said second end surface and formed with a latch recess communicated with said core receiving space, a first shackle mounting portion that extends from said lock core mounting portion in a first transverse direction transverse to the longitudinal direction and that is formed with a first shackle insert hole, and a second shackle mounting portion that extends from said latch receiving portion in the first transverse direction and that is opposite to said first shackle mounting portion, said second shackle mounting portion being formed with a second shackle insert hole that is aligned with said first shackle insert hole in the longitudinal direction, said second shackle mounting portion being further formed with a slide channel that extends in the first transverse direction to communicate said second shackle insert hole with said latch recess;

(b) a key-operated lock core unit including a cylindrical lock core formed with a keyhole and disposed in said core receiving space, said lock core being adapted to be rotated inside said core receiving space upon insertion of a corresponding key into said keyhole, said lock core having one end disposed adjacent to said latch recess, and a latch member connected to said one end of said lock core and extending into said latch recess, said latch member being rotatable inside said latch recess between locking and unlocking positions when the corresponding key is operated;

(c) a shackle bar having a first end extending into said first said shackle insert hole, and a second end extending into said second shackle insert hole, at least one of said first and second ends being removable from a corresponding one of said first and second shackle insert holes; and (d) a catch member disposed slidably in said latch recess and having a first abutment wall which is formed with a shackle engaging projection that extends into said slide channel, a second abutment wall spaced apart from said first abutment wall in the first transverse direction, and a latch cavity defined between said first and second abutment walls for extension of said latch member thereinto, said latch member pushing said first abutment wall of said catch member for moving said catch member in the first transverse direction toward said second shackle mounting portion so as to enable said shackle engaging projection to project into said second shackle insert hole for engaging said shackle bar when said latch member is disposed in the locking position, said latch member pushing said second abutment wall of said catch member for moving said catch member in a direction opposite to the first transverse direction away from said second shackle mounting portion so as to enable said shackle engaging portion to retract into said slide channel for disengaging from said shackle bar when said latch member is disposed in the unlocking position;

wherein said latch member has a size sufficient for retraction into said core receiving space and for removal of said lock core unit from said core receiving space when said latch body is retracted into said slide passage;

wherein said latch receiving portion of said lock casing is formed with a radial hole adapted to permit insertion of a tool therein for retracting said latch body into said slide passage to permit removal of said lock core unit from said core receiving space when said latch member is disposed in the unlocking position.

* * * * *